United States Patent [19]

Erumsele

[11] Patent Number: 4,787,631

[45] Date of Patent: Nov. 29, 1988

[54] ACTION GAME FOR CHILDREN

[76] Inventor: Mary C. Erumsele, 2503 Fowler's La., Reston, Va. 22091

[21] Appl. No.: 930,264

[22] Filed: Nov. 14, 1986

[51] Int. Cl.[4] ..... A63B 69/00

[52] U.S. Cl. ..... 273/1 GF; 273/286

[58] Field of Search ..... 273/19, 1 GF, 146, 405, 273/286; 272/1 E, 70.3, 100, 111, 114

[56] References Cited

U.S. PATENT DOCUMENTS

| | | | |
|---|---|---|---|
| 1,490,201 | 4/1924 | Brown | 273/1 GF |
| 2,950,120 | 8/1960 | Stewart | 272/114 |
| 3,008,718 | 11/1961 | Berliner | 273/286 X |
| 3,111,313 | 11/1963 | Parks | 273/1 GF |
| 3,193,286 | 7/1965 | Sitter | 272/114 |
| 3,356,367 | 12/1967 | Tewksbury | 272/114 X |
| 3,544,112 | 12/1970 | Cornblatt | 273/405 |
| 3,545,747 | 12/1970 | Thomas | 273/1 GF |
| 3,984,110 | 10/1976 | Eckert | 273/286 |
| 4,281,830 | 8/1981 | Rehbein | 273/1 E |
| 4,422,645 | 12/1983 | Simons | 273/286 |

FOREIGN PATENT DOCUMENTS

| | | | |
|---|---|---|---|
| 1501915 | 10/1967 | France | 273/286 |

OTHER PUBLICATIONS

Reader's Digest Book of 1000 Family Games, ©1971, pp. 56–58.

*Primary Examiner*—Paul E. Shapiro
*Attorney, Agent, or Firm*—William F. Frank

[57] ABSTRACT

A game comprising a playing surface and at least one log-like unit upon which a player balances himself and attempts to move from one end of the playing surface to the other end with minimum instances of falling off the log-like unit.

2 Claims, 2 Drawing Sheets

ACTION GAME FOR CHILDREN

FIELD OF INVENTION

The present invention is the field of games for children which require motion by the players. More specifically, the present invention is in the field of games requiring a sense of balance as well as an ability to move linearly.

BACKGROUND OF THE INVENTION

Among the games played by children which require dexterity in movement coupled with a sense of balance, one of the first which comes to mind is hop skotch. In this game, the player must not only be able to leap or jump forward, but also maintin his balance, be it on one foot in the early plays, but also be able to convert the play from one foot to two feet, back to one foot and then to two feet again. Being played on a flat surface, the requirement for balance is minimized to the extent of not losing the sense of vertical balance so at to have to take an additional step to avoid falling out of the particular space.

Heretofore, there are no known games which require a player to not only maintain his balance but also move himself forward toward a pre-established goal.

Also to be considered as a possible contrast, is the attraction of walking, or at least trying, along a train rail. This exercise in balance is fortunate in that a would be walker is only 3–4 inches from the ground. There is also the attraction of walking along the top rail of a wooden fence. This attraction is only negated by the possible injury resulting from a fall from the top rail. Such self-inducted games require only a sense of balance on a stationary horizontal member.

There is, however, a sport which requires ability and also agility, to maintain one's equilibrium on an object which has longitudinal stability but is also subject to rotational instability if not properly controlled. In short this is the log rolling contest which is a major part of all lumberjack contests. Such contest require a body of water in which a log is floating. This content requires an ability to not only balance oneself on the log but to do so while the log is being rotated either by one's self or the opponent.

There is no known game which requires a player to maintain his balance on a cylindrical object and at the same time move himself along a playing surface.

SUMMARY OF THE PRESENT INVENTION

The present invention comprises a playing surface and at least one log-like unit upon which a player balances himself and attempts to move himself from one end of the playing surface to the other end of the playing surface with minimum instances of falling off the log-like unit.

BRIEF DESCRIPTION OF THE DRAWINGS

The present invention can be seen in an illustrative embodiment of the accompanying drawings.

DETAILED DESCRIPTION OF THE INVENTION

Figure 1:
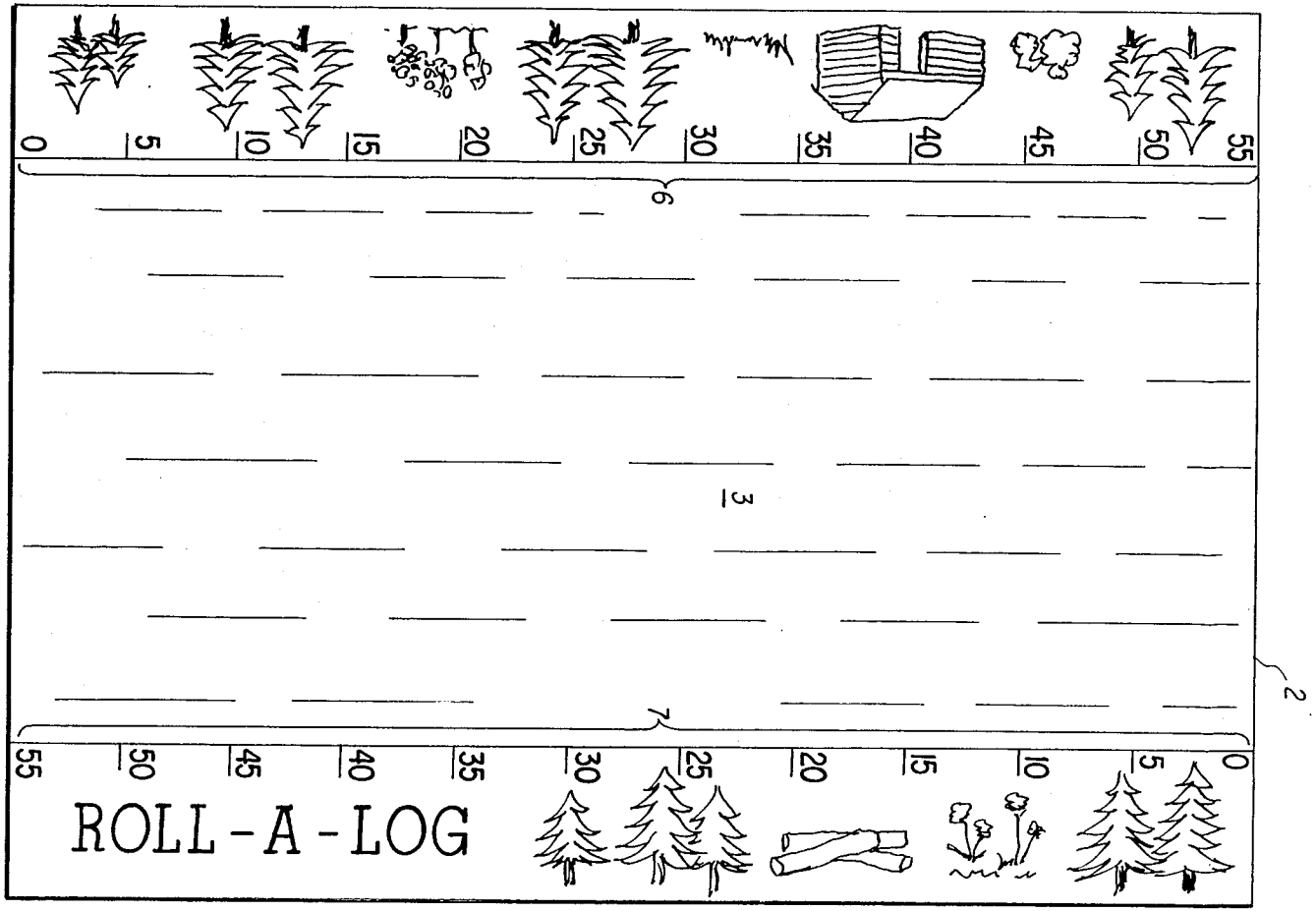
FIG. 1 is a plan view of the playing surface of the present invention, the reverse side being substantially blank.

Referring now to FIG. 1, there is seen a playing surface 1 comprising a flat sheet 2 displaying a playing area 3 which is colored to represent a body of water. Along each side of the playing area 3 are decorative representations 4 and 5 which depict woodland or primitive settings suggesting the atmosphere of the lumberjack log-rolling contest previously mentioned. Sheet 2 may be formed from any synthetic material having the stability to remain in place as the game is played or maybe in the form of a rug-type flooring covering for a family or recreation room. Also to be seen in FIG. 1 are sideline linear markings 6 and 7 whose purpose will be explained subsequently but which can be seen to be reversed.

Figure 2:
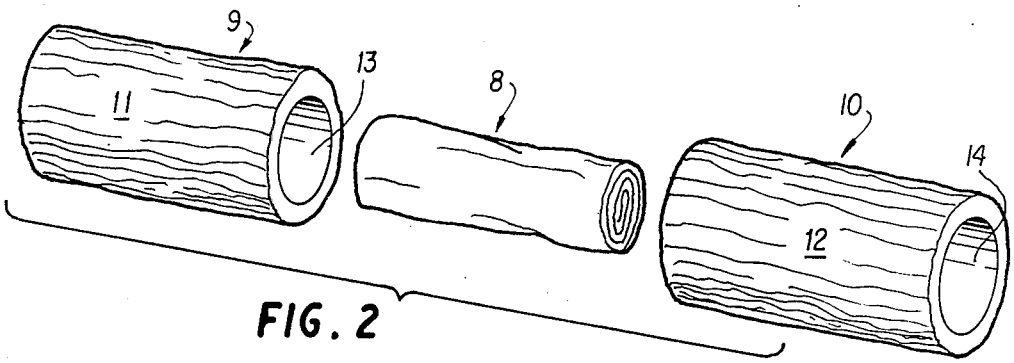
FIG. 2 is a perspective view of the present invention showing the playing surface of FIG. 1 in a rolled up or transport position and the two playing elements.

Referring now to FIG. 2, the playing sheet 2 is shown in a rolled up form 8 for transport and/or storage. Also to be seen are the playing elements 9 and 10 of the present game. Each playing element is a log-like element substantially identical having a simulated bark-like surface 11 and 12. Such bark-like surface may comprise a coating of bark-simulated sheet or having the realistic bark-like texture as a result of the formulation of the elements 9 and 10. The elements 9 and 10 having hollow interiors 13 and 14, thereby forming the elements 9 and 10 as hollow cylinders. The hollowness of the log-like elements 9 and 10 serves two purposes. The first is to minimize weight. The log-like elements are preferably 12–18 inches in length and 4–8 inches in diameter. The second purpose of the hollow log-like elements is to provide a means to store and transport a rolled up playing sheet.

Referring back to FIG. 1, it is to be recognized that working elements 6 and 7 have the numerals so displayed in opposition to each other. The relevance and/or application of such reversals will be explained subsequently in reference to the play of the game.

Figure 3:
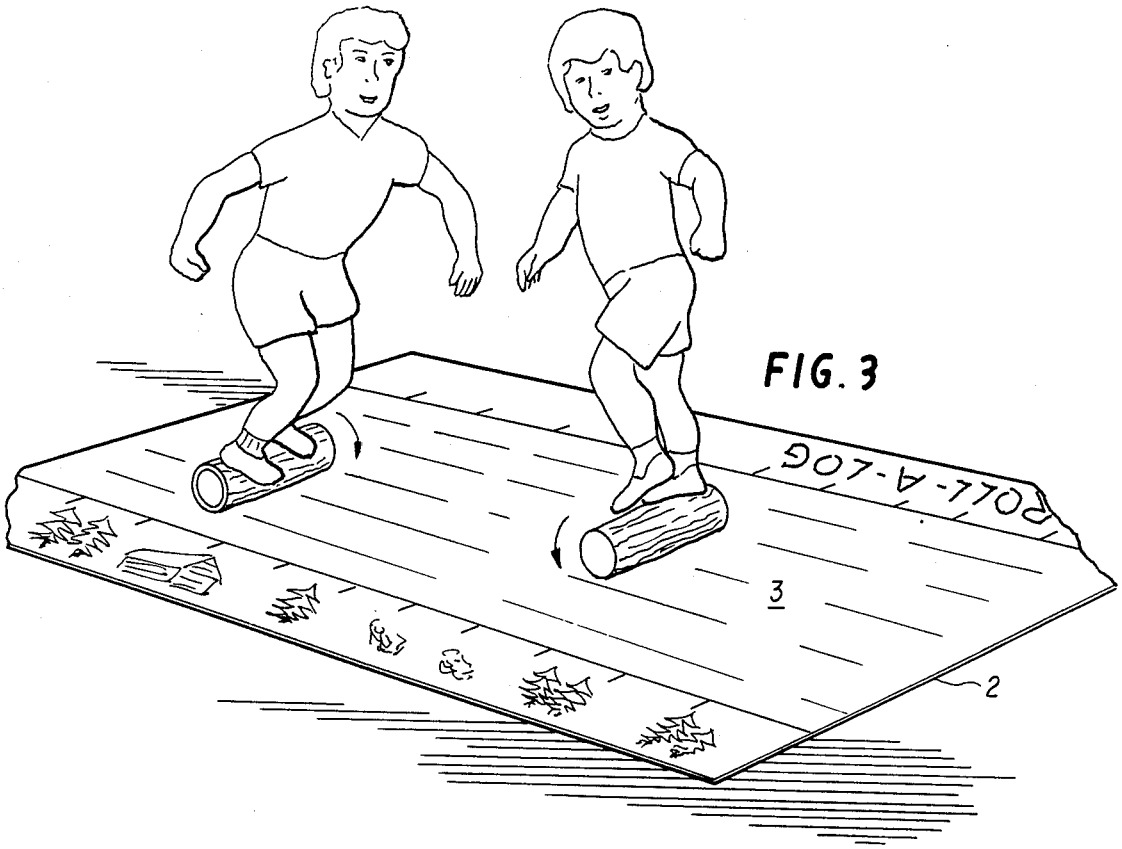
FIG. 3 is a schematic perspective view of the present invention showing the game in playing position.
Figure 4:
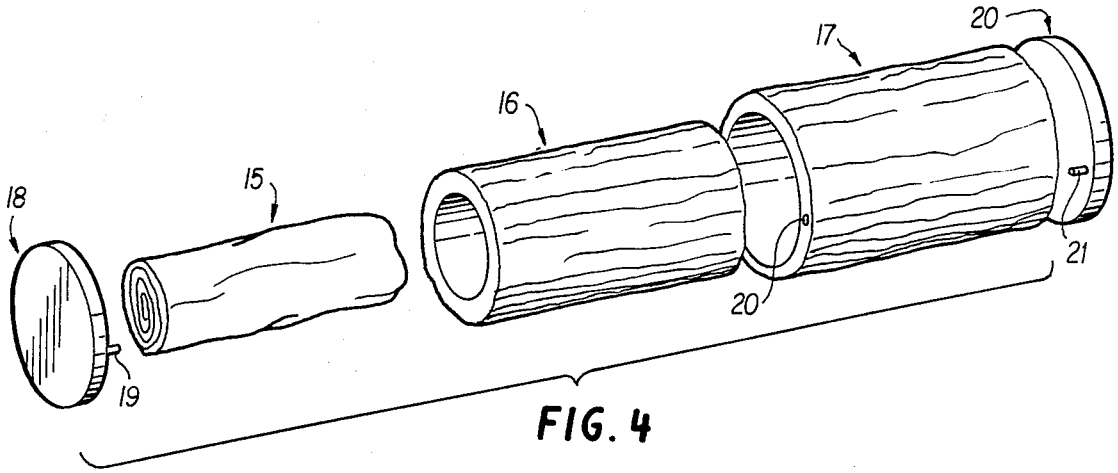
FIG. 4 shows an exploded view of the present invention as it is displayed before storage.

Reference to FIG. 3 depicts two players in the game. It is apparent that the players are moving in opposite directions rather than racing one another in the same direction. This figure will be further identified in the subsequent description of the game.

The embodiment of the game shown in FIG. 2 proposes that the rolled up playing surface 15 is inserted into either one of the playing elements 9 or 10 for storage or transport. FIG. 3 encompasses this concept in that the rolled up playing surface 15 is insertable into playing element 16 which is substantially identical to playing element 9, rolled up playing surface 15 being in substantially a frictionally fit within playing element 16. Playing element 16 is insertable within playing element 17, again at a slidable, frictional fit. While the frictional engagement of rolled up playing surface 15 and playing element 16 may be sufficient to retain these elements within playing element 17, it is within the scope of the present invention to include at least one cap 18 having at least one pin 19 to frictionally engage recess 20 in playing element 17 to constrain elements 15, 16 and 17 when combined for storage or transport. Optionally, the present invention may include a base cover 20 having a plug 21 to engage a recess in the adjacent end of playing element (not visible).

While the invention, particularly as seen in FIG. 3 is to be seen as a competitive game, it is to be understood that the game can be played by a single player basically to develop the skills of balance and simultaneously achieve movement. The minimal diameter of the playing elements minimizes or eliminates the possiblity of injury should the player fall off the playing element.

PLAY OF THE INVENTION

As stated previously, the present invention is a land-based version of the familiar log-rolling contests of the lumberjacks. To this end, the players start at opposite ends of the playing area 3. The ultimate object of the game of the present invention is to determine which of the players is firs table to negotiate the length of the playing surface.

In the simplest form of contest, each player places his log at the opposite ends of the playing surface and mounts the log and begins to roll the log toward the opposite end. At this point it is noted that the players should play in stocking feet or a shoe whie has a non-slick sole. Each player begins to move his log forward. If he falls off before reaching the opposite end, he places the log at the point where he fell off and again tries to roll the log to the opposite end, the player first reaching the opposite end with the log being the winner.

In a modified version of the aforementioned play, a record is made of each point on the sideline linear markings 6 and 7 at which the player falls off the log, the player restarting the play at the scale point at which he lost control of the log and fell off. When the player finally reaches the opposite end of the player surface the total of the scale points is determined and the player with the lowest point scale total is the winner.

In another version of the above described method of determining the winner, the player again begins the play at the highest sideline linear marking point (55) of the playing surface. When the player loses control of his log, the point on the point scale is noted and the player returns his log to the start and again rolls it forward toward the low scale point (0). When each player finally reaches the opposite end (0), the points at which the player lost control of the log are totaled and the player with the lowest total is the winner.

In the present invention there is no restriction as to the length of the playing surface. The width is obviously such as to permit two players moving in opposite directions to pass each other without interference. The composition of the playing surface is limited only in the sense that the rolling of the log will not result in movement of the surface so as to move with the movement of the logs. Therefore the playing surface of the present invention must have a stability either in the composition of the playing sheet or in the under surface of the playing sheet. Modifications of the present invention as described above as may occur to those of skill in the art are considered to be within the scope of the present invention as recited in the accompanying claims.

What is claimed is:

1. An action game comprising an elongated playing surface comprising an elongated playing area having scoring indicia alongside each edge of said surface in reverse order and a pair of hollow log-like playing pieces, wherein each of said log-like playing pieces comprises a hollow cylindrical object having an outer surface resembling the bark-like texture of a natural log segment, said playing area having an underface which is resistant to longitudinal movement of the area as a reaction to the rolling motion of said log-like playing pieces, said playing area having a flexibility to permit it to be folded and rolled up so as to be fitted completely into at least one of said hollow log-like playing pieces for storage and transport of the game, and the other of said log-like playing pieces is of a diameter to accept the one of said log-like playing pieces as an insert.

2. The game according to claim 1 wherein said playing area symbolizes an area of water.

* * * * *